US007905288B2

(12) United States Patent
Kinkead

(10) Patent No.: US 7,905,288 B2
(45) Date of Patent: Mar. 15, 2011

(54) OLEFIN METATHESIS FOR KEROGEN UPGRADING

(75) Inventor: Scott A. Kinkead, Los Alamos, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 79 days.

(21) Appl. No.: 12/277,531

(22) Filed: Nov. 25, 2008

(65) Prior Publication Data

US 2009/0133935 A1 May 28, 2009

Related U.S. Application Data

(60) Provisional application No. 60/996,621, filed on Nov. 27, 2007.

(51) Int. Cl.

| | |
|---|---|
| ***E21B 43/22*** | (2006.01) |
| ***E21B 43/25*** | (2006.01) |
| *C07C 4/06* | (2006.01) |
| *C10G 1/10* | (2006.01) |

(52) U.S. Cl. ..... 166/300; 166/305.1; 208/435; 585/646

(58) Field of Classification Search ..... None
See application file for complete search history.

(56) References Cited

U.S. PATENT DOCUMENTS

| | | | | |
|---|---|---|---|---|
| 3,489,672 | A | 1/1970 | Schulman et al. | |
| 4,162,808 | A | 7/1979 | Kvapil et al. | |
| 4,269,780 | A * | 5/1981 | Banasiak | 554/163 |
| 5,091,076 | A | 2/1992 | So et al. | |
| 6,991,032 | B2 | 1/2006 | Berchenko et al. | |
| 7,121,342 | B2 | 10/2006 | Vinegar et al. | |
| 7,500,517 | B2 * | 3/2009 | Looney et al. | 166/250.01 |
| 2008/0006410 | A1 * | 1/2008 | Looney et al. | 166/308.4 |
| 2009/0281364 | A1 * | 11/2009 | Halsey | 585/646 |

OTHER PUBLICATIONS

"Olefin metathesis", Wikipedia, http://en.wikipedia.org/wiki/Olefin metathesis, last updated on May 29, 2008, retrieved on Jun. 24, 2010.*

R.H. Grubbs, "Olefin Metathesis," Tetrahedron, vol. 60, pp. 7117-7140 (2004).

R.R. Schrock et al., "Molybdenum and Tungsten Imido Alkylidene Complexes as Efficient Olefin-Metathesis Catalysts," Angew. Chem. Int. Ed., vol. 42, pp. 4592-4633 (2003).

Trnka et al., "The Development of L2X2Ru=CHR Olefin Metathesis Catalysts: An Organometallic Success Story," Acc. Chem. Res., vol. 34, pp. 18-29 (2001).

* cited by examiner

*Primary Examiner* — George Suchfield
(74) *Attorney, Agent, or Firm* — Merchant & Gould

(57) ABSTRACT

A method for chemically-upgrading shale-bound kerogen comprises contacting shale-bound kerogen comprising carbon-carbon double bonds with a quantity of alkene species in the presence of an olefin metathesis catalyst. A catalyzed metathetical reaction occurs between the shale-bound kerogen and the alkene species and smaller kerogen-derived molecular species are formed. The smaller kerogen-derived molecular species are recovered.

17 Claims, 1 Drawing Sheet

OLEFIN METATHESIS FOR KEROGEN UPGRADING

This application claims priority to U.S. Provisional Application Ser. No. 60/996,621, filed Nov. 27, 2008, entitled "Olefin Metathesis Reactions for Kerogen Upgrading", which is incorporated herein by reference in its entirety.

FIELD OF ART

The present disclosure is generally related to kerogen upgrading, and more specifically to the use of olefin metathesis reaction pathways to upgrade kerogen.

BACKGROUND

1. Oil Shale

A particularly attractive alternative source of energy is oil shale, the attractiveness stemming primarily from the fact that oil can be "extracted" from the shale and subsequently refined in a manner much like that of crude oil. Technologies involving the extraction, however, must be further developed before oil shale becomes a commercially-viable source of energy. See J. T. Bartis et al. *Oil Shale Development in the United States: Prospects and Policy Issues*, RAND Corporation, Arlington, Va., 2005.

The largest known deposits of oil shale are found in the Green River Formation, which covers portions of Colorado, Utah, and Wyoming. Estimates on the amount of recoverable oil from the Green River Formation deposits are as high as 1.1 trillion barrels of oil—almost four times the proven oil reserves of Saudi Arabia. At current consumption levels (~20 million barrels per day), these shale deposits could meet the energy demands of the United States for the next 140 years (Bartis et al.).

Oil shale typically consists of an inorganic component (primarily carbonaceous material, i.e., a carbonate) and an organic component (kerogen). Thermal treatment can be employed to break (i.e., "crack") the kerogen into smaller hydrocarbon chains or fragments, which are gas or liquids under retort conditions, and facilitate separation from the inorganic material. This thermal treatment of the kerogen is also known as "thermal upgrading" or "retorting," and can be done at either the surface or in situ, where in the latter case, the fluids so formed are subsequently transported to the surface.

In some applications of surface retorting, the oil shale is first mined or excavated, and once at the surface, the oil shale is crushed and then heated (retorted) to complete the process of transforming the oil shale to a crude oil—sometimes referred to as "shale oil." See, e.g., Shuman et al., U.S. Pat. No. 3,489,672. The crude oil is then shipped off to a refinery where it typically requires additional processing steps (beyond that of traditional crude oil) prior to making finished products such as gasoline, lubricant, etc. Various chemical upgrading treatments can also be performed on the shale prior to the retorting. See, e.g., So et al., U.S. patent application Ser. No. 5,091,076.

2. In Situ Upgrading of Shale-Bound Kerogen

A method for in situ retorting of carbonaceous deposits such as oil shale has been described in U.S. Pat. No. 4,162,808. In this method, shale is retorted in a series of rubblized in situ retorts using combustion (in air) of carbonaceous material as a source of heat.

The Shell Oil Company has been developing new methods that use electrical heating for the in situ upgrading of subsurface hydrocarbons, primarily in subsurface formations located approximately 200 miles (320 km) west of Denver, Colo. See, e.g., U.S. Pat. Nos. 7,121,342 and 6,991,032. In such methods, a heating element is lowered into a well and allowed to heat the kerogen over a period of approximately four years, slowly converting (upgrading) it into oils and gases, which are then pumped to the surface. To obtain even heating, 15 to 25 heating holes could be drilled per acre. Additionally, a ground-freezing technology to establish an underground barrier around the perimeter of the extraction zone is also envisioned to prevent groundwater from entering and the retorting products from leaving. While the establishment of "freeze walls" is an accepted practice in civil engineering, its application to oil shale recovery still has unknown environmental impacts. Additionally, the Shell approach is recognized as an energy intensive process and requires a long timeframe to establish production from the oil shale.

3. Chemical Upgrading of Shale-Bound Kerogen

Chemical routes to the upgrading of shale-bound kerogen have many advantages—particularly with regard to in situ upgrading. Such molecular-based methodologies generally entail contacting the kerogen with a reactive species capable of breaking carbon-carbon bonds within the kerogen and/or bonds between the kerogen and inorganic components of the shale. A result of such bond breaking is a more mobile kerogen-derived molecule that can more easily be transported out of the subsurface formation in which it was formed. Such methodologies are attractive for a variety of reasons including, but not limited to, lower energy requirements, scalability, specificity and flexibility. Such methodologies have been described in U.S. patent application Publication 2008/0006410 A1. Once at the surface, the kerogen based product can be further processed.

A need remains for efficient and effective methods for chemically upgrading shale-bound kerogen and extracting kerogen from oil shale deposits in order to better take advantage of oil shale as an alternative source of energy.

SUMMARY

Provided is a method for chemically-upgrading shale-bound kerogen. The method comprises contacting shale-bound kerogen comprising carbon-carbon double bonds with a quantity of alkene species in the presence of an olefin metathesis catalyst. A catalyzed metathetical reaction occurs between the shale-bound kerogen and the alkene species and smaller kerogen-derived molecular species are formed. The smaller kerogen-derived molecular species are then recovered or isolated.

BRIEF DESCRIPTION OF THE DRAWING

For a more complete understanding of the presently disclosed method, and the advantages thereof, reference is now made to the following descriptions taken in conjunction with the accompanying drawing, in which.

DETAILED DESCRIPTION

Figure 1:
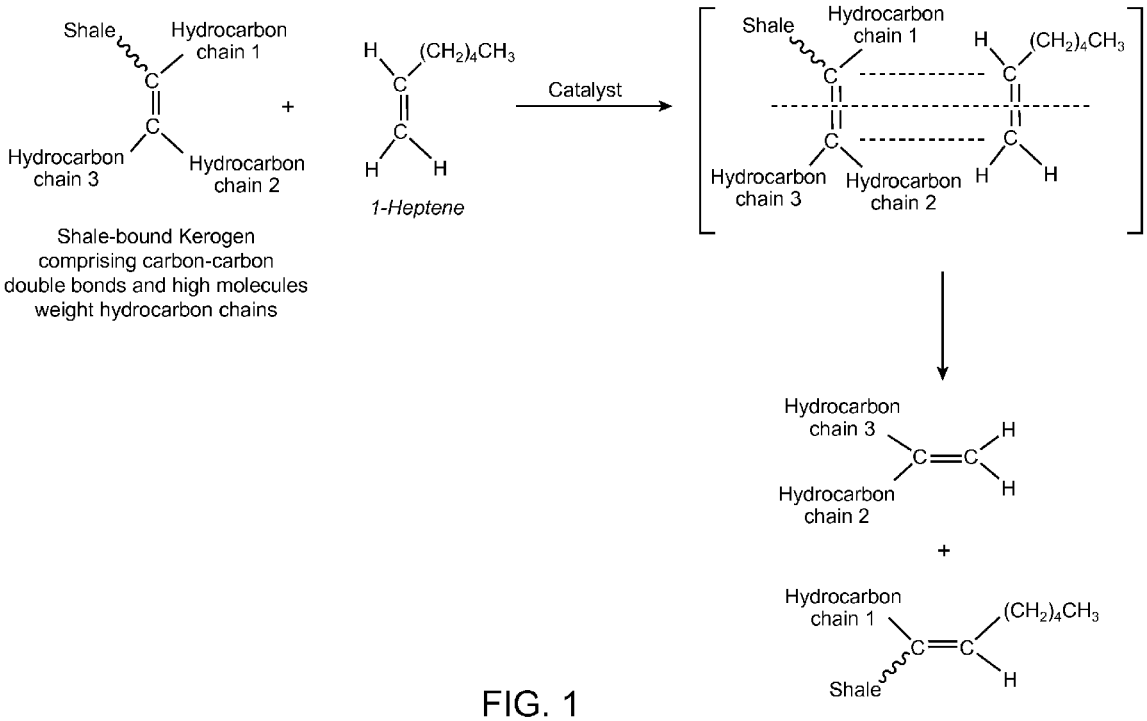
FIG. 1 schematically depicts a chemically-based upgrading of kerogen using olefinic species in the presence of an olefin metathesis catalyst (e.g., Grubbs' catalyst).

"Kerogen," as used herein and as mentioned above, is an organic component of shale. On a molecular level, kerogen comprises very high molecular weight molecules that are generally insoluble by virtue of their high molecular weight and likely bonding to the inorganic component of the shale. The position of kerogen that is soluble is known as "bitumen"; bitumen typically being the heaviest component of crude oil. In fact, in a geologic sense, kerogen is a precursor to crude oil. Kerogen is typically identified as being one of five types: Type I, Type II, Type II-sulfur, Type III, or Type IV, based on its C:H:O ratio and sulfur content, the various types generally being derived from different sources of ancient biological matter.

Embodiments of the presently disclosed method are generally directed to chemical upgrading of kerogen by reacting it with a significantly smaller olefin (alkene) in the presence of a catalyst. The large kerogen molecules, comprising multiple C=C bonds, will undergo olefin metathesis with the smaller olefin at these sites and yield kerogen-derived species that are more easily processible than are the parent kerogen molecules.

Olefin metathesis is a metal-catalyzed redistribution of olefinic (alkenyl) carbon-carbon double bonds between two or more reactants. This work was largely pioneered by Grubbs and Schrock, who shared the 2005 Nobel Prize and who have their names associated with many of the catalyst species utilized for these reactions. See, e.g., R. H. Grubbs, "Olefin Metathesis," Tetrahedron, vol. 60, pp. 7117-7140 (2004); R. R. Schrock et al., "Molybdenum and Tungsten Imido Alkylidene Complexes as Efficient Olefin-Metathesis Catalysts," Angew. Chem. Int. Ed., vol. 42, pp. 4592-4633 (2003); and Trnka et al., "The Development of $L_2X_2Ru{=}CHR$ Olefin Metathesis Catalysts: An Organometallic Success Story," Acc. Chem. Res., vol. 34, pp. 18-29 (2001).

The olefin metathesis catalyst is a transition metal complex comprising a metal selected from the group consisting of Ni, W, Ru, Mo, Re, and combinations thereof. In one embodiment, the olefin metathesis catalyst is a transition metal complex comprising Ru.

In an embodiment, a well is drilled in a kerogen-containing underground oil shale formation. Via well access, the formation is fractured to enhance the fluid accessibility of the kerogen contained therein. A mixture of Grubb's catalyst and 1-heptene is then contacted with the kerogen via the fracture access. Contact of the mixture with the kerogen results in a low-temperature in situ chemical upgrading of the kerogen. The contacting can be carried out in a solvent. The chemistry involved is shown in the Figure. In certain embodiments the catalyzed metathetical reaction occurs spontaneously upon contacting the shale-bound kerogen with the alkene species in the presence of the olefin metathesis catalyst. The upgraded kerogen-derived product (now mobile) is then transported to the surface. This method represents a molecular approach to the in situ subsurface upgrading of kerogen.

Following chemical upgrading of the kerogen, the catalyst can be recovered as well as recycled and/or reused. In an embodiment, the contact of the mixture with the kerogen is performed at surface level.

In some embodiments, the upgraded kerogen-derived product is further upgraded (thermally and/or chemically) at the surface to yield one or more commercial petroleum-based products. Various surface techniques common in the industry (e.g., catalytic cracking, hydroprocessing, thermal cracking, denitrofication, desulfurization) may be employed to obtain a desired commercial product from the upgraded kerogen-derived product. Such additional surface upgrading is largely dependent on the nature of the upgraded kerogen-derived product relative to the commercial product that is desired. The phrase "commercial petroleum-based products," as used herein, refers to commercial products that include, but are not limited to, gasoline, aviation fuel, diesel, lubricants, petrochemicals, and the like. Such products could also include common chemical intermediates and/or blending feedstocks. The further upgrading (i.e., at the surface) can be intermediate to subsequent refining.

In some embodiments, an olefin other than 1-heptene, for example, an octane, a hexane, or other olefin, is used. In some or other embodiments, mixtures of olefins are used. Also, variations on the above-described embodiments can have application for the low-temperature chemical upgrading of coal, heavy oil and/or tar sands.

All patents and publications referenced herein are hereby incorporated by reference to the extent not inconsistent herewith. It will be understood that certain of the above-described structures, functions, and operations of the above-described embodiments are not necessary to practice the presently disclosed method and are included in the description simply for completeness of an exemplary embodiment or embodiments. In addition, it will be understood that specific structures, functions, and operations set forth in the above-described referenced patents and publications can be practiced in conjunction with the presently disclosed presently disclosed method, but they are not essential to its practice. It is therefore to be understood that the presently disclosed method can be practiced otherwise than as specifically described without actually departing from the spirit and scope of the appended claims.

What is claimed:

1. A method for chemically-upgrading shale-bound kerogen, said method comprising the steps of:

a) contacting shale-bound kerogen comprising carbon-carbon double bonds with a quantity of alkene species in the presence of a olefin metathesis catalyst, wherein a catalyzed metathetical reaction occurs between the shale-bound kerogen and the alkene species and smaller kerogen-derived molecular species are formed; and b) recovering the smaller kerogen-derived molecular species.

2. The method of claim 1, wherein the contacting is performed in situ in a subsurface environment.

3. The method of claim 2, further comprising recovering the smaller kerogen-derived molecular species at surface level.

4. The method of claim 3, further comprising transporting the smaller kerogen-derived molecular species to surface level.

5. The method of claim 2, wherein prior to conducting the step of contacting the shale-bound kerogen with the alkene species in the presence of an olefin metathesis catalyst, a well is drilled into a kerogen-containing underground shale formation.

6. The method of claim 1, wherein the olefin metathesis catalyst is a transition metal complex comprising a metal selected from the group consisting of Ni, W, Ru, Mo, Re, and combinations thereof

7. The method of claim 1, wherein the olefin metathesis catalyst is a transition metal complex comprising Ru.

8. The method of claim 1, wherein the olefin metathesis catalyst is a Grubbs' catalyst.

9. The method of claim 1, wherein the step of contacting is carried out in a solvent.

10. The method of claim 1, wherein the catalyzed metathetical reaction occurs spontaneously upon contacting the shale-bound kerogen with the alkene species in the presence of the olefin metathesis catalyst.

11. The method of claim 1, wherein the smaller kerogen-derived molecular species are mobile and no longer bound to the shale.

12. The method of claim 11, wherein the smaller kerogen-derived molecular species are recovered by exploiting their mobility.

13. The method of claim 1, wherein the catalyzed metathetical reaction chemically deconstructs the shale-bound kerogen.

14. The method of claim 1, wherein the alkene species comprises 1-heptene.

15. The method of claim 1, further comprising recovering the olefin metathesis catalyst from metathetical reaction product.

16. The method of claim 15, further comprising reusing the olefin metathesis catalyst to catalyze additional metathetical reaction between shale-bound kerogen and alkene species.

17. The method of claim 1, wherein the smaller kerogen-derived molecular species is upgraded to yield one or more commercial petroleum-based products.

* * * * *